US005669861A

United States Patent [19]

Toups

[11] Patent Number: 5,669,861

[45] Date of Patent: Sep. 23, 1997

[54] INCLINE RESISTANCE WEIGHT UNIT FOR EXERCISE MACHINE

[76] Inventor: Lanny J. Toups, 338 Meadowcreek Dr., Ducanville, Tex. 75137

[21] Appl. No.: 648,803

[22] Filed: Apr. 18, 1996

[51] Int. Cl.[6] ..... A63B 21/00

[52] U.S. Cl. ..... 482/98; 482/99; 482/101; 482/133

[58] Field of Search ..... 482/92–94, 97–103, 482/133, 135, 136–138, 112, 113, 114, 123, 129, 130; 74/99.15, 99 A

[56] References Cited

U.S. PATENT DOCUMENTS

| | | | |
|---|---|---|---|
| 367,340 | 7/1887 | Fleak | 74/89.15 X |
| 813,015 | 2/1906 | Munson | 74/89.15 |
| 4,052,906 | 10/1977 | Genini | 74/89.15 X |
| 4,863,161 | 9/1989 | Telle | 482/97 |
| 5,320,143 | 6/1994 | Hwang et al. | 74/89.15 X |

*Primary Examiner*—Richard J. Apley
*Assistant Examiner*—John Mulcahy
*Attorney, Agent, or Firm*—John E. Vandigriff

[57] ABSTRACT

The invention is to a weight device that creates a controlled and infinitely variable transpositional force greater than the weight being lifted. A vertical shaft has a pair of grooves which spiral about the shaft, increasing the slope from the bottom to the top of the shaft. A pair of rollers in the grooves have shafts that extend through and support a sleeve that is placed over the vertical shaft. The roller shafts are mounted in a pair of mounts that are on each side of the vertical shaft. A sprocket pulley is mounted on an end of the vertical shaft. As the sprocket is turned, the rollers are moved up the grooves, moving the sleeve upward against an increasing resistance to upward movement. A stack of weights surrounds the sleeve for movement therewith.

9 Claims, 9 Drawing Sheets

| Position | Angle | Multiple |
|---|---|---|
| 1 | 45 ° | 1.00 |
| 2 | 48 ° | 1.07 |
| 3 | 51 ° | 1.24 |
| 4 | 54 ° | 1.38 |
| 5 | 57 ° | 1.54 |
| 6 | 60 ° | 1.73 |
| 7 | 63 ° | 1.96 |
| 8 | 66 ° | 2.25 |
| 9 | 69 ° | 2.60 |
| 10 | 72 ° | 3.08 |
| 11 | 75 ° | 3.73 |
| 12 | 78 ° | 4.70 |

Figure 6

INCLINE RESISTANCE WEIGHT UNIT FOR EXERCISE MACHINE

FIELD OF THE INVENTION

This invention relates to exercise machines and devices, and more particularly to a weight unit that includes the combination of an incline ramp and one or more weights to provide the resistance for an exercise machine.

BACKGROUND OF THE INVENTION

Exercise machines generally have as a weight element a plurality of weights that are stacked with a pair of parallel bars extending through the weights to keep them stacked and to provide a vertical path for the weights. A third rod extends down through the stacked weights and has a row of holes extending through the rods corresponding to holes in the weights. By inserting a pin into a hole in a weight and through to a corresponding pin in the third rod, all weights above the weight into which the pin is inserted will be the weights that are to be lifted. The weights are connected by cables and pulleys to one of several handles or pedals that are pushed with the feet or grasped by the hands to lift the weights. Machines utilizing such weight apparatus are heavy and only the exact amount of weight in the stack of weights is available for use.

SUMMARY OF THE INVENTION

The invention is to a weight device that creates a controlled and infinitely variable transpositional force greater than that of the weight being lifted. A vertical bar has a pair of inclined tracks in the bar. A pair of rollers in the inclined tracks have shafts that extend through and support a sleeve that is placed over the bar. The roller shafts are mounted in a pair of mounts that are on each side of the bar. A sprocket pulley is mounted on an end of the bar. As the sprocket is turned, the rollers are moved up the inclined tracks, moving the sleeve upward.

The sleeve has a plurality of holes along part of its length. Also a plurality of weights are positioned on the sleeve such that a pin extending though one of the weights also extends through one of the holes in the sleeve. When the sleeve is moved upward as the sprocket is turned and the rollers move in the tracks, the sleeve and one or more weight is moved upward. Because the inclined tracks are at a continuously varying slope, the greater the slope, the greater the effective weight or resistance to moving the weight up the slope.

The weight device creates a controlled and infinitely transpositional force greater than the weight being lifted. The device will create a controlled decrease in the amount of resistive force needed to control downward motion of the suspended weight as the weight is lowered, thus reducing the potential for injury.

The weight device is designed to provide infinitely selectable resistance that can be applied to any machine which is designed to exercise specific muscle groups. It provides isokinetic and isotonic resistance. The point at which maximum resistance is achieved is variable and adjustable.

The technical advance represented by the invention as well, as the objects thereof, will become apparent from the following description of a preferred embodiment of the invention when considered in conjunction with the accompanying drawings, and the novel features set forth in the appended claims.

BRIEF DESCRIPTION OF THE DRAWINGS

FIG. 6 is a chart showing the resistance multiple based on the angle of incline;

DESCRIPTION OF A PREFERRED EMBODIMENT

Figure 1:
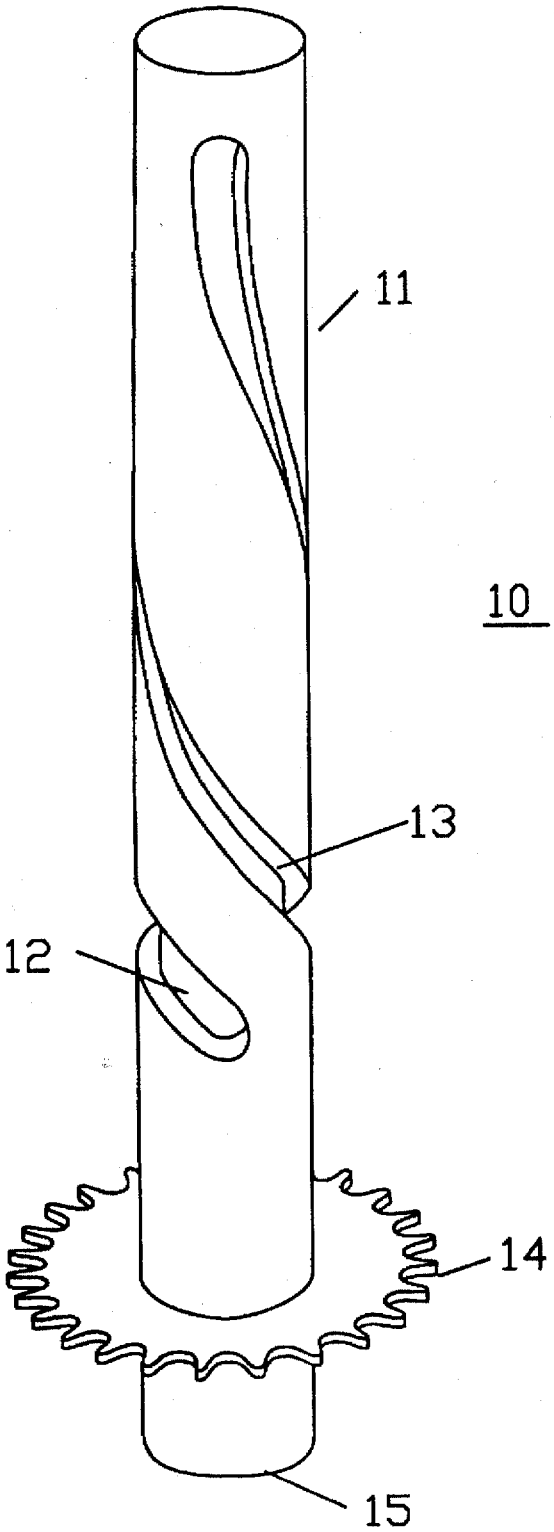
FIG. 1 shows the shaft portion of the incline resistance unit of present invention with two incline grooves of varying slope extending upward the length of the shaft.

FIG. 1 shows the shaft used in the incline resistance unit of the invention. Shaft 10 has a cylindrical body 11 that has two grooves 12 and 13 that incline upward in a spiral of varying slope. The slope can increase or decrease dependent upon rotation and result in varying resistance. In one embodiment of the invention, for example, the grooves 12 and 13 start with an incline of about 45 degrees and increase to about 78 degrees. Shaft 11 has a sprocket pulley wheel 14 positioned above end 15. Shaft 11 is solid except for grooves 12 and 13.

Figure 2:
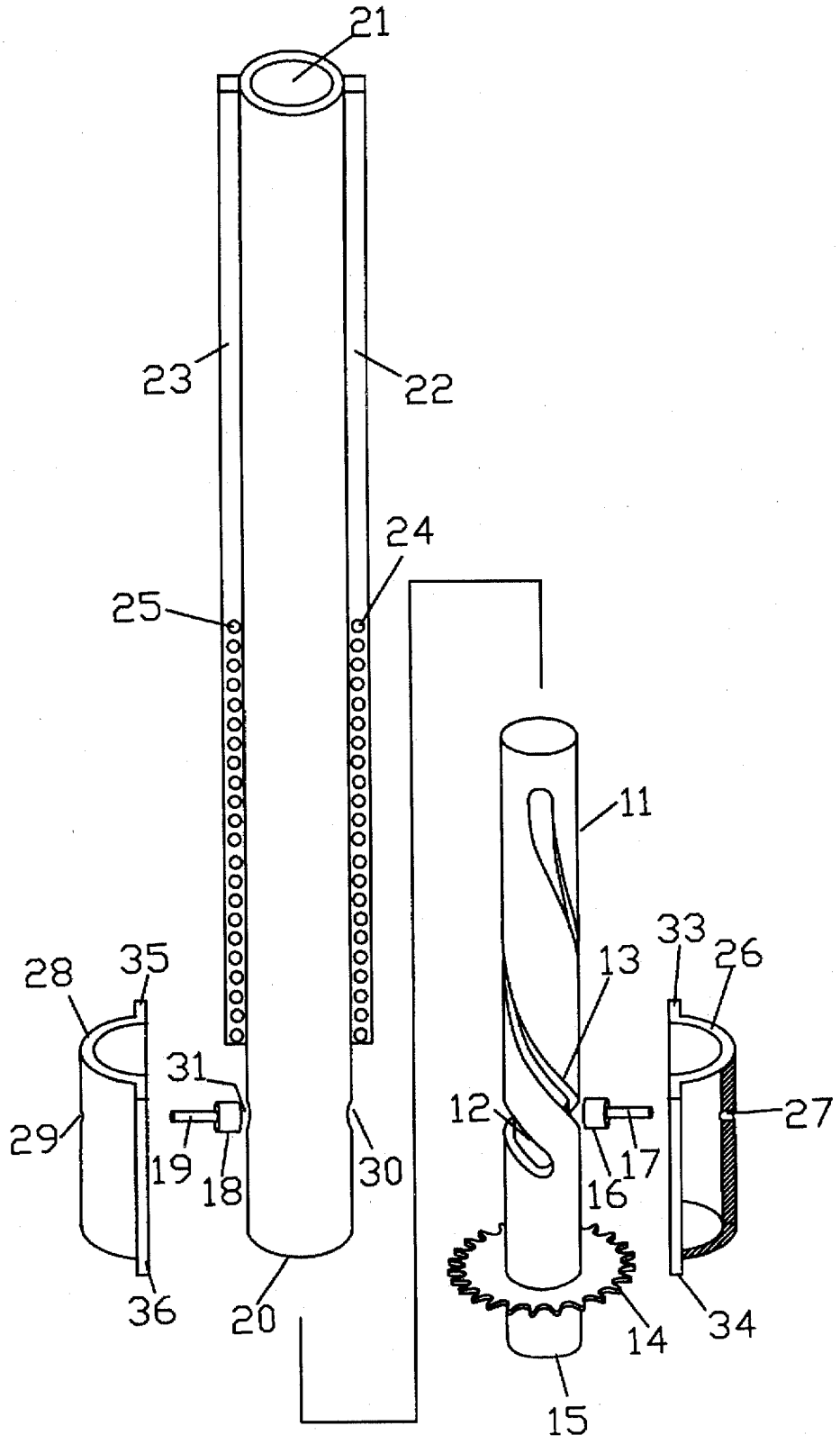
FIG. 2 shows the shaft of FIG. 1 and a sleeve that fits over the shaft, and rollers that move in the grooves.

FIG. 2 shows shaft 11 along with cylinder 20, side brackets 26 and 28, and rollers 16 and 18. Cylinder 20 is a hollow cylinder, with internal opening 21 extending the length of cylinder 20, with openings 30 and 31 extending through the walls of cylinder 20. Two rails 22 and 23 are mounted on cylinder 20 diagonally opposite from each other on cylinder 20. There are a plurality of equally spaced holes 24 extending through rail 22. Similarly, there are a plurality of equally spaced holes 25 extend through rail 23. Cylinder 20 is placed over shaft 11. Rollers 16 and 18 extend through holes 30 and 31, respectively, in cylinder 20 and reside in grooves 13 and 12, respectively, in shaft 11. Two brackets, 26 and 28, are clamped around cylinder 20 with shaft 17 or roller 16 extending out opening 27, and shaft 19 of roller 18 extending out opening 29.

A partial cross-section view of bracket 26 shows hole 27 extending though the wall of bracket 26. Bracket 26 has flanges 33 and 34, and bracket 28 has flanges 35 and 36, which are bolted together as shown in FIG. 3.

Figure 3:
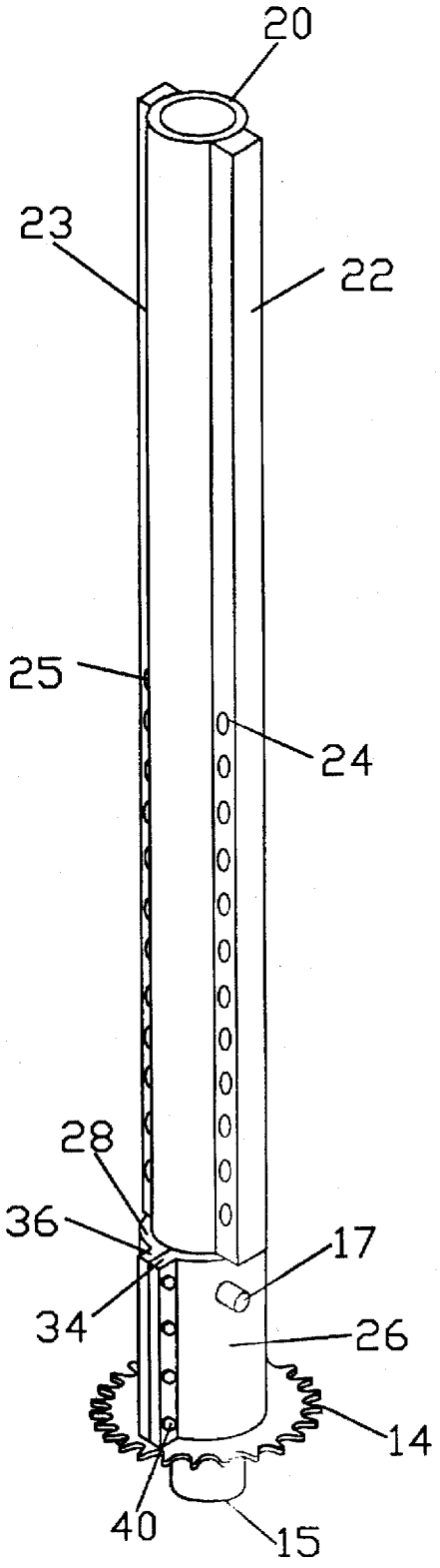
FIG. 3 shows the sleeve over the shaft.
Figure 3A:
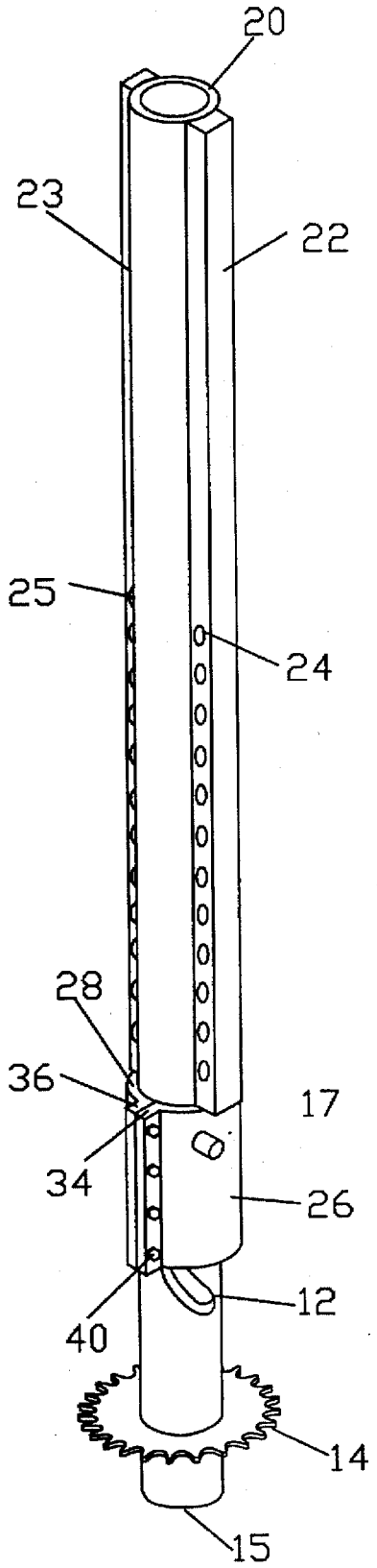
FIG. 3*a* show the sleeve in a raised position on the shaft.

FIG. 3 show cylinder 20 placed over shaft 11 and brackets 26 and 28 bolted together with bolts 40, holding brackets 26 and 28 around cylinder 20. Shaft 17 is shown extending out hole 27 in bracket 26. FIG. 3*a* shows that by rotating sprocket pulley 14, cylinder 20 and brackets 26 and 28 move upward as roller 18 moves upward in groove 12. While not shown, roller 16 has also moved up in groove 13.

Figure 4:
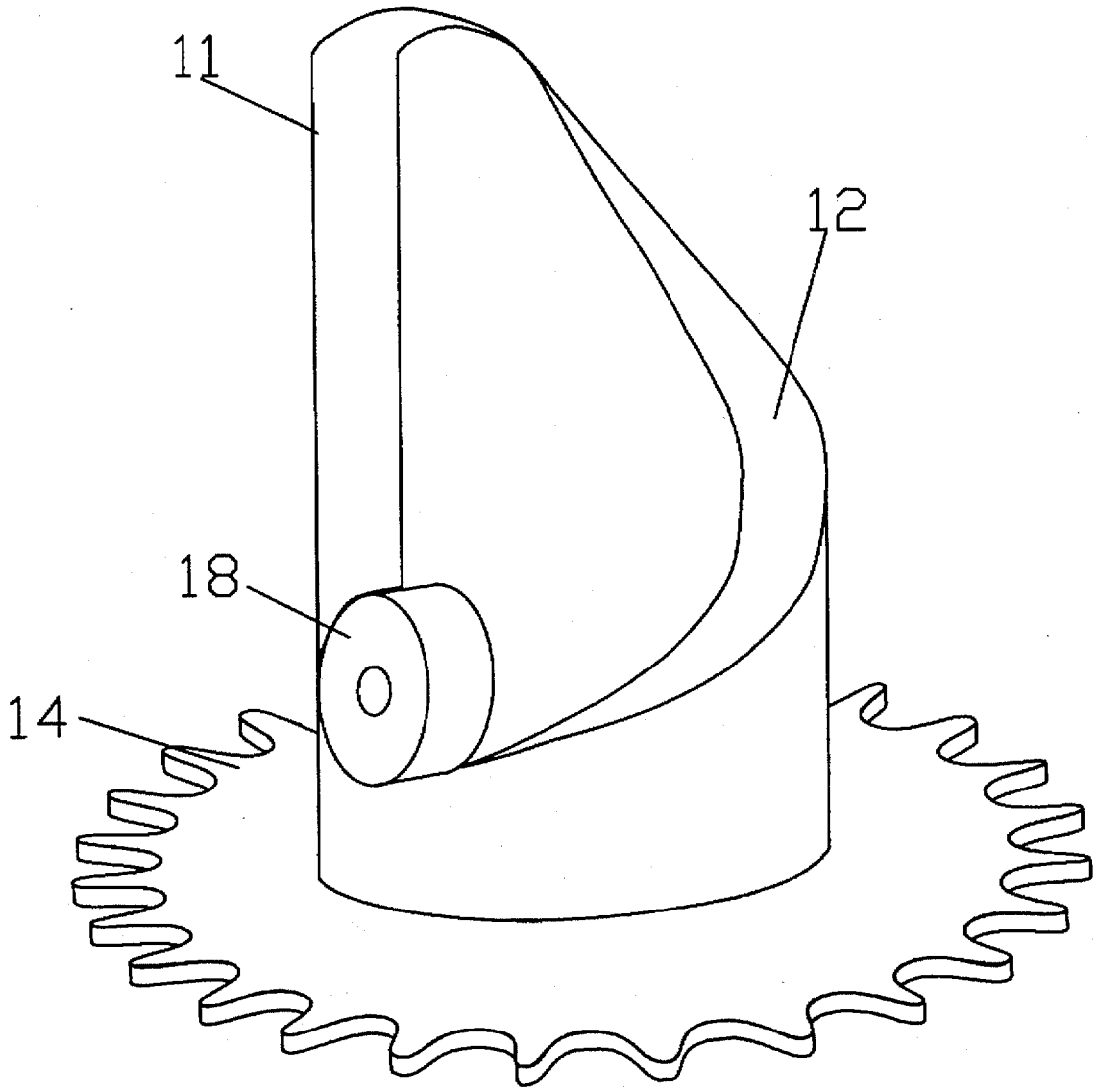
FIG. 4 shows a cut-away portion of the shaft showing the incline of the grooves.

FIG. 4 is a cut-away of shaft 11 showing groove 12. As pulley 14 rotates shaft 11, roller 18 moves up the incline of groove 12. Similarly, while not shown, roller 16 moves up the incline of groove 13.

Figure 5:
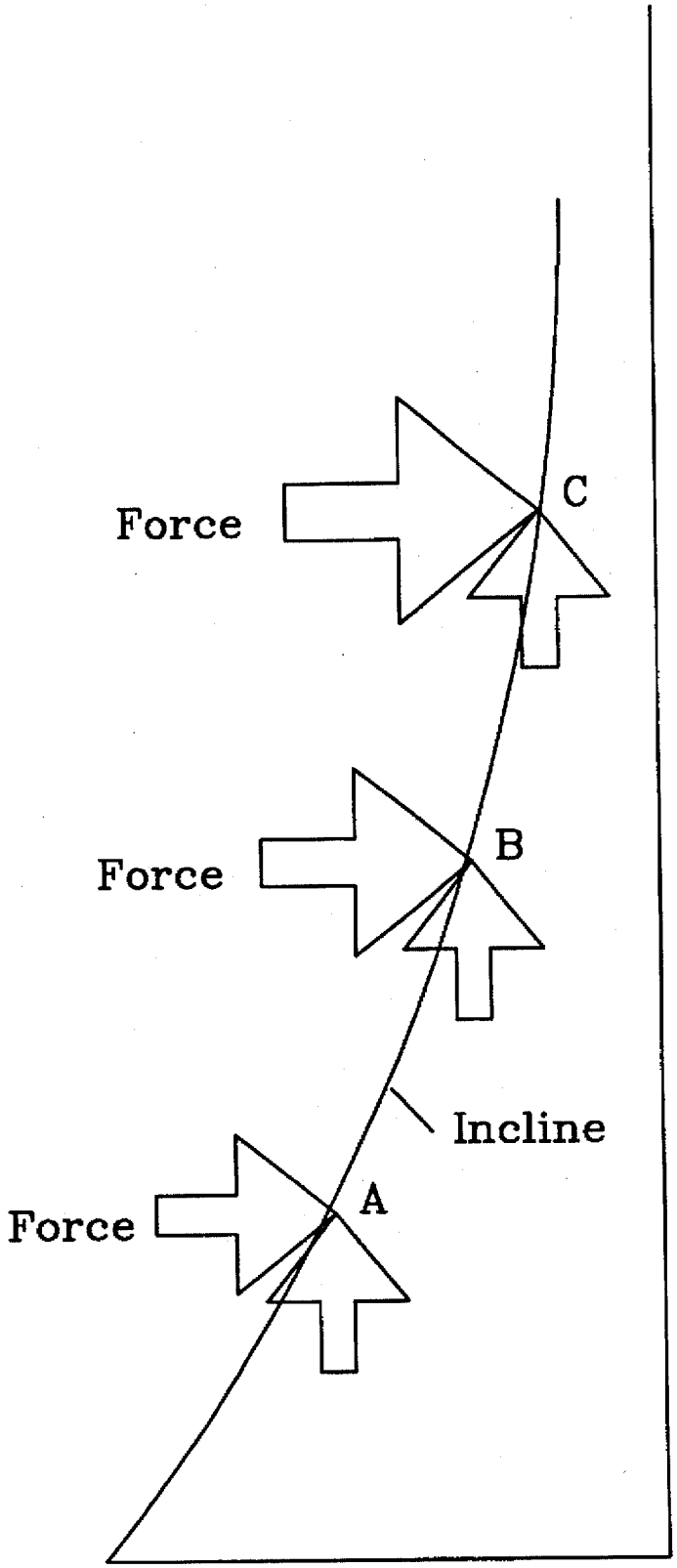
FIG. 5 shows the principle of inclimetric resistance.

FIG. 5 illustrates the variable resistance presented by rollers 16 and 18 moving up, respectively, inclines 13 and 12. At point A there are two components of force required to move up the incline, the vertical component and the horizontal component. As the incline increases, at points B and C, the horizontal component increases, but the vertical component remains the same. The slope of the incline equals variable resistance.

FIG. 6 is a table showing the resistance multiple as the slope, or angle, of the incline increase. For example, at the bottom of grooves 12 and 13, the incline is 45°. As rollers 12 and 13 move up grooves 12 and 13, the angle increase, increasing the multiple of a given weight. At 60°, the multiple is 1.73. This means that a weight of 10 pounds has an effective resistance of 17.3 pounds. At an incline of 78°, a ten pound weight has an effective resistance of 47 pounds.

Figure 7:
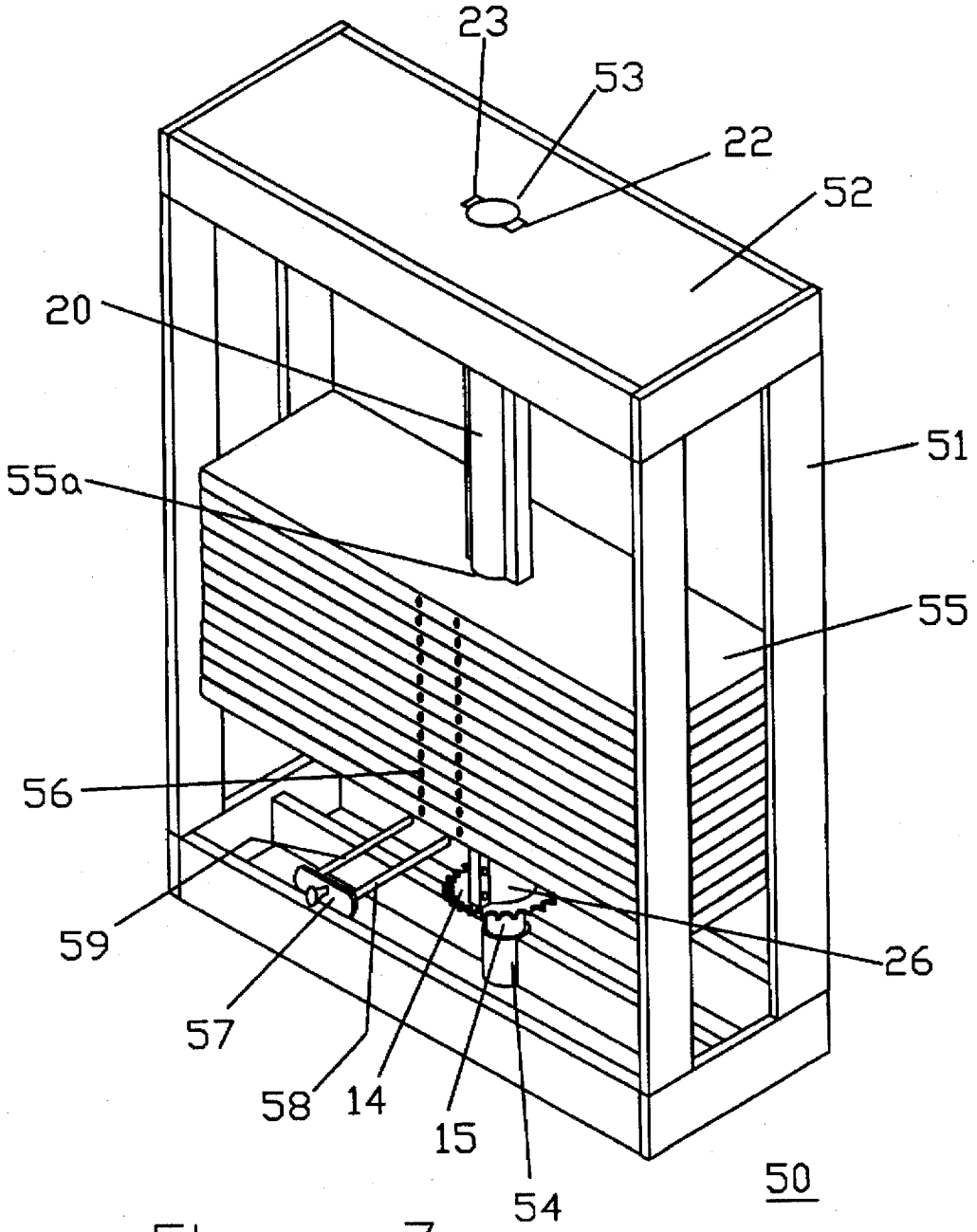
FIG. 7 shows a weight unit in conjunction with the incline resistance unit.

FIG. 7 shows a weight unit for use with an exercise apparatus utilizing the inclimetric resistance apparatus of the invention. Weight unit 50 includes a frame 51 and a top 52. Cylinder 20 and bars 22 and 23 extend to and are supported by top 52. End 15 of shaft 11 is supported in cross brace 54. A set of individual weights 55 are stacked with cylinder 20 and bars 22 and 23 extend up though opening 55*a* in weights 55. A set of pins 58 and 59 are mounted on handle 57 and may be inserted in openings 56 in weights 55. At any one position of pins 58 and 59, all weights above the weight in which pins 58 and 59 are inserted are lifted when pulley sprocket 14 is rotated. Pins 58 and 59, when inserted in one of weights 55 also are inserted in a pair of holes 24, 25 in bars 22, 23. Therefore, when pulley sprocket 14 is rotated, cylinder 20 and all the weights above and including the weight in which pins 58 and 59 are inserted are raised as rollers 16 and 18 (FIG. 2) move up incline grooves 12 and 13. The movement up the incline of grooves 12 and 13 adds to the resistance of the lifted weight depending upon the degree of incline at a particular point on the incline. This is shown in the table of FIG. 6.

Figure 8:
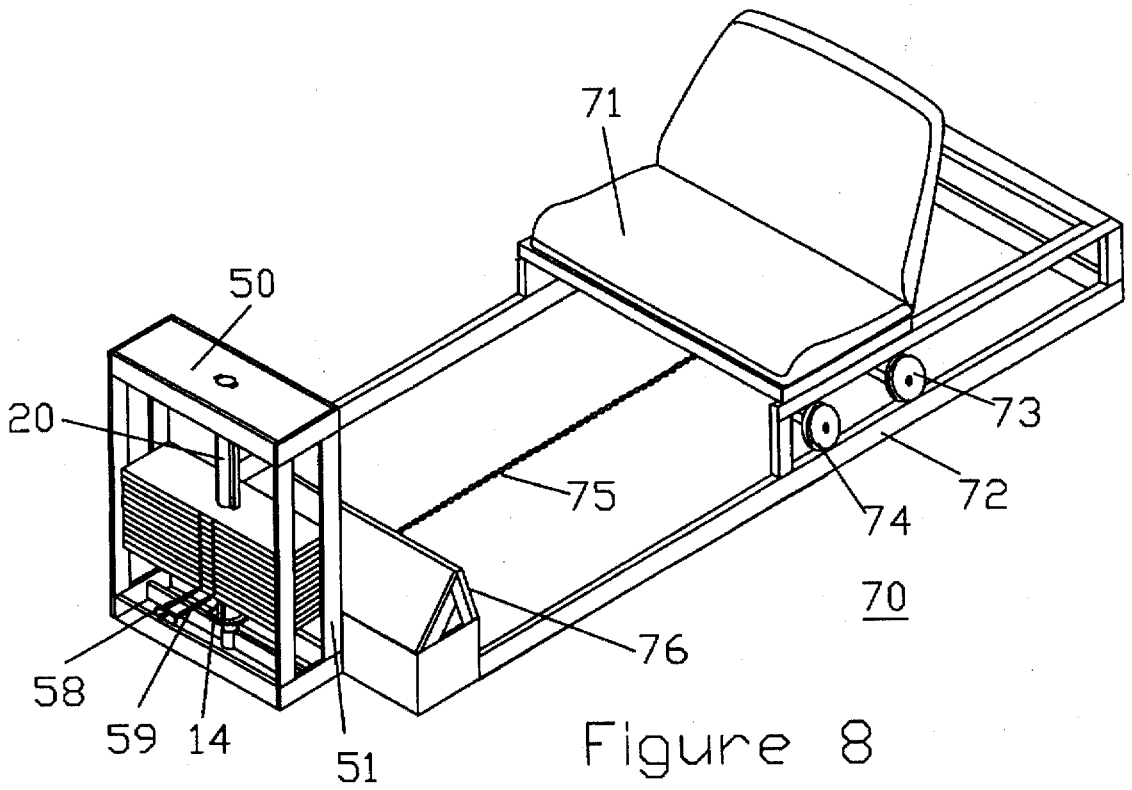
FIG. 8 shows an exercise apparatus utilizing the invention.

FIG. 8 shows an example of an exercise apparatus using the weight unit of FIG. 7. While this is only one example, any exercise apparatus that utilizes a set of weights can use the weight unit of FIG. 7. Weight unit 70 includes a frame 72 on which a seat 71 is mounted. Seat 71 has a plurality of wheels including wheels 73 and 74 that roll on frame 72. A chain or cable 75 is connected to seat 71 and around sprocket pulley 14. When a users sits on seat 71 and pushes against foot panel 76 seat 71 is moved backward causing pulley 14 to turn, raising cylinder 20 and any weights held to cylinder 20 by pins 58 and 59. By repeatedly pressing feet against panel 76 and releasing them weights are raise and lowered on weight unit 50. The actual weight lifted depends upon the number of weights lifted by cylinder 20 and the position of rollers 16 and 18 (FIG. 2) along the inclines of grooves 12 and 13. The higher the position of rollers 16 and 18 in grooves 12 and 13, the greater the effective weight being lifted. Weight unit 50 will create a controlled and infinitely variable transpostional force greater than the actual weights being lifted. Similarly, weight unit 50 will create a controlled decrease of the effective weight or resistive force needed to resist downward movement of the actual suspended weight as the weight is lowered.

What is claimed:

1. A device for use in conjunction with weights to produce a controlled infinitely variable transpositional resistant force greater than the resistant force created by such weights being lifted alone, comprising:

a vertically mounted shaft having at least one groove of increasing slope from a first end to a second end of the shaft in the surface thereof in a spiral around the shaft;

a pulley mounted at one end of said shaft for rotating said shaft;

a roller, having a roller shaft extending out one side of the roller, for moving in said groove;

a sleeve over said shaft with the roller shaft extending though an opening in said sleeve;

a pair of brackets around said sleeve holding said roller in the shaft groove;

a frame and top part for mounting said shaft and holding said sleeve to prevent it from turning during rotation of said shaft; and means on said sleeve for connecting a plurality of weights to move with the sleeve;

wherein as said pulley is turned, rotating said shaft, said roller moves upward in said groove moving said sleeve vertically up the shaft.

2. The device according to claim 1, wherein there are two spiral grooves in said shaft and a roller in each groove.

3. The device according to claim 1, wherein as said groove spirals up said shaft, the angle of incline of the groove varies.

4. The device according to claim 1, wherein said connecting means includes a pair of bars diagonally opposite each other on said sleeve, said bars each having a plurality of spaced holes along a part of each bar's length.

5. An exercise apparatus comprising:

a vertically mounted shaft having at least one groove of increasing slope from a first end to a second end of the shaft in the surface thereof in a spiral around the shaft;

a pulley mounted at one end of said shaft for rotating said shaft;

a roller, having a roller shaft extending out one side of the roller, for moving in said groove;

a sleeve over said shaft with the roller shaft extending though an opening in said sleeve;

a pair of brackets around said sleeve holding said roller in the shaft groove;

a frame and top part for mounting said shaft and holding said sleeve to prevent it from turning during rotation of said shaft;

a movement means operatively connected to said pulley for movement by a user during an exercise; and a resistance means for resisting movement of said sleeve;

wherein said pulley is upon movement of said movement means, rotating said shaft whereby said roller moves upward in said groove moving said sleeve vertically up the shaft against said resistance.

6. The apparatus according to claim 5, wherein there are two spiral grooves in said shaft and a roller in each groove.

7. The apparatus according to claim 5, including a pair of bars diagonally opposite each other on said sleeve, said bars each having a plurality of spaced holes along a part of each bar's length for selectively connecting said resistance means to said sleeve.

8. The apparatus according to claim 7, said resistance means includes weights, said weights having a central opening through the weight through which said sleeve and bars extend, said weights being attachable to said bars by extending at least one pin through a transverse hole in said weight and through one of said plurality of spaced holes in one of said bars.

9. A weight resistance device to produce a controlled infinitely variable transpositional resistant force greater than the resistant force created by the weights being lifted alone, comprising:

a vertically mounted shaft having at least one groove of increasing slope from a first end to a second end of the shaft in the surface thereof in a spiral around the shaft;

a pulley mounted at one end of said shaft for rotating said shaft;

a roller, having a roller shaft extending out one side of the roller, for moving in said groove;

a sleeve over said shaft with the roller shaft extending though an opening in said sleeve;

at least one bracket on said sleeve having a plurality of spaced holes therein;

a pair of brackets around said sleeve holding said roller in the shaft groove;

a frame and top part for mounting said shaft and holding said sleeve to prevent it from turning during rotation of said shaft;

a pair of bars diagonally opposite each other on said sleeve, said bars each having a plurality of spaced holes along a part of each bar's length; and a set of weights, said weights having a central opening through which said sleeve and bars extend, said weights being attachable to said bars by extending at least one pin through a transverse hole in one of said weights and through one of said plurality of spaced holes in one of said bars.

* * * * *